United States Patent [19]

Mendiratta et al.

[11] Patent Number: 4,663,027

[45] Date of Patent: May 5, 1987

[54] METHOD FOR REMOVING POLYHALOGENATED HYDROCARBONS FROM NON-POLAR ORGANIC SOLVENT SOLUTIONS

[75] Inventors: Ashok K. Mendiratta, Schenectady; Wayne F. Morgan, Mechanicville, both of N.Y.

[73] Assignee: General Electric Company, Schenectady, N.Y.

[21] Appl. No.: 835,574

[22] Filed: Mar. 3, 1986

[51] Int. Cl.[4] ..... C10G 29/04

[52] U.S. Cl. ..... 208/262; 585/469

[58] Field of Search ..... 208/262; 585/469

[56] References Cited

U.S. PATENT DOCUMENTS

| | | | |
|---|---|---|---|
| 4,337,368 | 6/1982 | Pytlewski et al. | 568/730 |
| 4,351,718 | 9/1982 | Brunelle . | |
| 4,353,793 | 10/1982 | Brunelle . | |
| 4,400,552 | 8/1983 | Pytlewski et al. . | |
| 4,410,422 | 10/1983 | Brunelle | 208/262 |
| 4,430,208 | 2/1984 | Pytlewski et al. | 208/262 |

*Primary Examiner*—Curtis R. Davis

*Attorney, Agent, or Firm*—Francis T. Coppa; James C. Davis, Jr.; James Magee, Jr.

[57] ABSTRACT

A method is provided for reducing the level of polychlorinated aromatic hydrocarbons dissolved in organic solvents at a faster rate wherein the organic solvent is treated with a glycol, such as polyethylene glycol, and an alkali metal hydroxide in the form of a uniform solids slurry.

19 Claims, No Drawings

METHOD FOR REMOVING POLYHALOGENATED HYDROCARBONS FROM NON-POLAR ORGANIC SOLVENT SOLUTIONS

BACKGROUND OF THE INVENTION

Polychlorinated biphenyls, or "PCB's", were long used as dielectric fluids in electrical equipment because these materials have excellent heat stability, are non-flammable in nature, have low volatility and good viscosity characteristics at operating temperatures. Because of their environmental persistence, however, continued manufacture, import or use in the United States was banned under the Toxic Substance Control Act of 1976, and the U.S. Environmental Protection Agency was directed to promulgate rules and regulations for their removal from the economy.

As of July 1, 1979, EPA regulations defined as "PCB-contaminated" any material containing more than 50 ppm of a mono, di or polychlorinated biphenyl. The regulations permit the disposal of PCB-contaminated materials by either incineration in an approved manner or in an approved landfill, but such procedures have rarely proven acceptable to community neighbors.

Since considerable fractions of the transformer oils and heat exchange oil now in service are PCB-contaminated, the problem of disposing of PCB-contaminated hydrocarbon oils in an effective manner presents a serious challenge. Various techniques for degrading a polyhalogenated aromatic hydrocarbons in such oils have been proposed. Most techniques are too lengthy and/or complex to provide a practical solution to the problem of PCB-contaminated oil. However, processes disclosed by Brunelle in U.S. Pat. Nos. 4,353,739, 4,351,718 and 4,410,422 provide rapid and effective degradation of PCB's in such oils. These processes utilize alkali metal hydroxides in combination with polyalkylene glycols and/or monoalkyl ethers of polyethylene glycol as a reagent to remove PCB's. These patents are assigned to the same assignee as the present invention and are incorporated herein by reference.

When removing PCB's from a solution on a large scale, such as in a commercial process, it is desirable to maximize the rate of reaction. One method for enhancing the rate of reaction in the Brunelle processes is to increase the surface area of the alkali metal hydroxide by utilizing smaller solids and providing a better suspension of solids. The KOH obtained commercially is in the form of pellets and/or flakes and must be crushed prior to use in the Brunelle process. The crushed particles provide a higher surface area and a better suspension. A corresponding increase in the reaction rate is obtained with these crushed particles.

Although crushing of the KOH pellets and/or flakes provides suitable results, there is room for improvement. Due to the hygroscopic nature of KOH, the crushing and handling of the KOH powder must be carried out in an inert atmosphere such as nitrogen. This complicates the crushing procedure. Furthermore, due to the limitation on grinding equipment, a wide particle size distribution is obtained for the KOH powder produced. This particle size distribution affects mixing procedures and mass transfer procedures in the reaction vessel. The system utilized must accept wide variances in solid size when mixing or transferring the reactor contents or the alkali metal hydroxide will form a sticky viscous mass on the equipment surfaces.

The present invention provides an improved method for removing polyhalogenated aromatic hydrocarbons from inert, organic solvent solutions which maximizes the surface area of the alkali metal hydroxide by forming fine solids without the use or complications of a grinding step. The solids obtained are smaller than those generated from conventional grinding processes and provide a more uniform suspension in the reaction medium. This uniform suspension enhances the reaction rate and permits the process to be adapted to continuous operation.

SUMMARY OF THE INVENTION

There is provided by the present invention a method for treating a substantially inert, organic solvent solution of a polyhalogenated aromatic hydrocarbon which comprises (A) admixing flakes and/or pellets of alkali metal hydroxide with a substantially inert, organic solvent solution containing polyhalogenated hydrocarbons to form a slurry of substantially uniform alkali metal hydroxide solids having an average size less than about 100 microns, the temperature of said organic solvent solution being sufficiently high to dissociate the flakes and/or pellets of alkali metal hydroxide and (B) forming a reaction mixture with said slurry, said reaction mixture having a temperature in the range of about 50° C. to 140° C. and comprising about (1) 0.1 to 10% by weight alkali metal hydroxide (2) 0.1 to 10% by weight glycol selected from the group consisting of polyalkylene glycol and monocapped polyalkylene glycol alkyl ether, and (3) an inert, organic solvent solution containing polyhalogenated aromatic hydrocarbons.

(C) agitating said reaction mixture for a time sufficiently long to reduce the quantity of polyhalogenated aromatic hydrocarbons in said reaction mixture.

An object of the present invention is to reduce the quantity of polyhalogenated aromatic compounds in inert organic solvents at a higher rate when utilizing alkali metal hydroxides and glycols.

Another object of the present invention is to reduce the quantity of PCB's in organic solvents utilizing commercially available KOH pellets and/or flakes without grinding or crushing these pellets and/or flakes.

A further object of the present invention is to reduce the quantity of PCB's in organic solvents utilizing KOH and PEG wherein the accumulation of sticky, viscous solids on the equipment surfaces is reduced.

An additional object of the present invention is to provide slurries of alkali metal hydroxide for the removal of PCB's which contain smaller solids and provide more uniform suspensions than those obtained by grinding and crushing.

Another object of the present invention is to provide slurries of alkali metal hydroxide solids for the removal of PCB's which are adaptable to a continuous operation.

DETAILED DESCRIPTION OF THE INVENTION

Examples of inert, organic solvent solutions which contain polyhalogenated aromatic hydrocarbons are transformer oils and heat exchange oils. The transformer oils are typically refined asphaltic-base mineral oils and the heat exchange oils are typically hydrogenated terphenyls. The term "transformer oil" as used herein signifies a mineral insulating oil of petroleum origin for use as an insulating and cooling media in electrical apparatus, for example, transformers, capacitors, underground cables, etc. These transformer oils are typically non-polar and inert.

The polyhalogenated aromatic hydrocarbon within the transformer oils and heat exchange oils is typically the polychlorinated biphenyls or PCB's described above as mono, di, or polychlorinated biphenyl. Such compounds were commonly used in transformer oils for their unique properties, such as low volatility and low flammability. The solutions which are treated preferably have a concentration of polyhalogenated aromatic hydrocarbon of up to 5% by weight based on the total weight of the solution.

To reduce the quantity of polyhalogenated aromatic hydrocarbon in organic solvents by this invention, a slurry of substantially uniform alkali metal hydroxide solids is produced and is used in combination with glycol. The small size and improved suspension of these solids enhances the rate of polyhalogenated aromatic hydrocarbon removal. The uniform size of these solids aids the mixing and material handling procedures of this process, making the process adaptable to continuous operation.

To obtain this solids slurry, an alkali metal hydroxide is admixed with the inert, organic solvent solution. The alkali metal hydroxide is in the form of flakes and/or pellets as it is obtained from commercial suppliers, herein referred to as "particles". An average particle size for such flakes and/or pellets commonly ranges from about $\frac{1}{8}''$ to $\frac{1}{2}''$ with a wide size distribution. Pellets are often about $\frac{1}{4}''$ in size and vary only slightly. Flake sizes do vary significantly and vary from supplier also. In addition, the purity of the alkali metal hydroxide varies. Pellets are typically 85% pure while flakes are typically 90% pure. The remaining portion of these particles is essentially moisture. The average particle size of the pellets and/or flakes after grinding or crushing is greater than 100 microns (1/250") with a wide size distribution. These ground or crushed particles are also suitable for use in the process of this invention. However, for this invention, it is unnecessary to grind or crush these particles prior to admixing.

The alkali metal hydroxides which can be used to form the reagents are, for example, sodium hydroxide, potassium hydroxide, cesium hydroxide and the like. The final concentration of such alkali metal hydroxides within the slurry preferably falls below about 50% by weight. Conventional mixing devices can provide the level of agitation needed for admixing.

The inert, organic solvent solution is maintained at a temperature sufficiently high to dissociate the particles of alkali metal hydroxide. Temperatures suitable for this purpose range from about 100° C. to 200° C. At temperatures within this range, the alkali metal hydroxide solids will dissociate or melt within the organic solvent depending upon the moisture content in the particles and the temperature. Temperatures above 200° C. are unnecessary and wasteful. The preferred temperature range is about 115° to 140° C. These temperatures are effective and generally fall below the melting temperature of the alkali metal hydroxide, such as potassium hydroxide. At these lower temperatures, the solid granules of alkali metal hydroxide break or dissociate possibly due to the release of moisture within the particles. Temperatures at or above 115° C. have been found to result in instantaneous dissociation for some commercially available KOH pellets and/or flakes.

Depending on the temperature of the inert organic solvent solution and moisture in the pellets and/or flakes, admixing will either provide a substantially uniform solids slurry, a two phase liquid mixture or a combination of both. Although temperatures above 140° C. are suitable, they may result in melting of the particles. Such temperatures are unnecessary in that the particles need only dissociate to provide the slurry of solids. Where all or a portion of the alkali metal hydroxide is molten, it is necessary to cool the admixed components. Upon cooling, the slurries obtained are essentially the same. The alkali metal hydroxide solids formed are substantially uniform in size and shape, having an average size less than 100 microns (1/250"). Therefore, to conserve energy and reduce possible oil degradation, it is preferable to avoid melting the alkali metal hydroxide by utilizing temperatures in the preferred range.

Cooling the admixed components can be achieved by introducing additional inert, organic solvent or another component of the reaction mixture which has a lower temperature. This may also serve to adjust the concentration of alkali metal hydroxide in the reaction mixture to a desired level.

This slurry of alkali metal hydroxide solids is used to form a reaction mixture which preferably comprises about 0.1 to 10% by weight alkali metal hydroxide, 0.1 to 10% by weight glycol and the inert, organic solvent solution which contains polyhalogenated aromatic hydrocarbons. The concentration of the organic solvent solution within the reaction mixture preferably ranges from about 75 to 99.8% by weight.

Since the slurry can have concentrations of alkali metal hydroxide above 10% by weight, additional inert organic solvent may be introduced to bring the concentration within the preferred range for the reaction mixture. Alternatively, the concentration of alkali metal hydroxide may fall within the preferred range for the reaction mixture when forming the slurry of alkali metal hydroxide solids.

The reaction mixture temperature falls within the range of about 50° C. to about 140° C. to maintain the alkali metal hydroxide in solid form. The preferred temperatures fall within the range of about 85° C. to 115° C. It may be necessary to cool the slurry to obtain these temperatures.

Experience has shown that agitation of the reaction mixture, such as stirring or shaking, is necessary to achieve effective results. Therefore, the reaction mixture is agitated for a period of time sufficiently long to reduce the quantity of polyhalogenated aromatic hydrocarbons in the reaction mixture. Preferably, the concentration of polyhalogenated aromatic hydrocarbons is reduced below 2 ppm. Conventional mixing devices are suitable for providing the level of agitation necessary.

The glycols which can be utilized include polyalkylene glycols as described by Brunelle in U.S. Pat. No. 4,351,718 and the monocapped-polyalkylene glycol alkyl ethers described by Brunelle in U.S. Pat. No. 4,353,739.

Of the glycols utilized, those which are preferred are, for example, polymers having a molecular weight in the range of about 200–5000. Where the glycol is a polyalkylene glycol, preferred species include, for example, tetraethylene glycol, pentaethylene glycol, hexaethylene glycol, etc. These polyethylene glycols can have molecular weights of, for example, 200, 300, 400, 600, 800, 1000, 1500, 3400, etc.

Where the glycol utilized is a monocapped polyalkylene glycol alkyl ether, preferred species include, for example, polyethylene glycol monoethyl ethers having molecular weights in the range of about 350 to 750, distributed by the Aldrich Chemical Company of Milwaukee, Wis. and polyethylene glycol methyl ethers.

It has been found that a proportion of 1 to 50 equivalents of alkali metal of the alkali metal hydroxide, per OH of the polyalkylene glycol or monocapped polyalkylene glycol alkyl ether can be used to make the M'OH/PEG or M'OH/PEGM reagents, respectively. For the above formulas, M' represents an alkali metal as previously defined with respect to the alkali metal hydroxide usage, while PEG and PEGM represent the preferred polyalkylene glycol, polyethylene glycol, and the preferred monocapped polyalkylene glycol alkyl ether, monocapped polyethylene glycol methyl ether, respectively. In addition, it has been found that at least one equivalent of alkali metal per OH of the PEG or PEGM will remove one equivalent of halogen atom from the polyhalogenated aromatic hydrocarbon. Higher amounts are preferred to facilitate chlorine removal from PCB's.

To effectively monitor the removal of polyhalogenated aromatic hydrocarbons such as PCB's from inert, non-polar, organic solvents; a vapor phase chromatograph (VPC), for example Model No. 3700, of the Varian Instrument Company, can be used in accordance with the following procedure: an internal standard, for example, N-docosane can be added to the initial reaction mixture. The standard is then integrated relative to the PCB envelope to determine the ppm concentration of PCB's upon vapor phase chromatograph analysis.

Due to the small size of the alkali metal hydroxide solids and the uniform size distribution of these solids, it has been found the formation of sticky viscous masses within the equipment utilized can be reduced. Therefore, filtration of the reaction mixture can be accelerated and the frequency at which cleansing the reaction equipment is required can be reduced. In addition, a more uniform suspension of solids is obtained which enhances the reaction rate. This uniform solids suspension also permits the process to be adaptable to continuous operation. The solids slurry can be added to a reaction vessel with glycol continuously without much variation in reactivity or reaction rate. Products can then be withdrawn continuously or semicontinuously.

In order that those skilled in the art will be better able to practice the present invention, the following examples are given by way of illustration and are not intended to limit the scope of this invention to the embodiments described. All parts are by weight unless otherwise indicated.

EXAMPLE 1

Transformer oil (1600 grams) contaminated with polychlorinated biphenyls (approximately 500 ppm) was poured into a reaction vessel and heated to 90° C. The reagents potassium hydroxide (32 grams) and monocapped polyethylene glycol methyl ether (32 grams, molecular weight 350) were added to the vessel. The potassium hydroxide used was in powder form. This powder was obtained by grinding potassium hydroxide pellets as obtained from MCB Chemical (about 85% anhydrous) in a blender. The reaction vessel contents were agitated throughout the run (3 inch pitched blade impeller, 600 rpm) and maintained at 90° C. Reaction was carried on for 20 minutes and samples were withdrawn for PCB analysis every 5 minutes. Following the reaction, the reactor contents were drained and a coating of solids was observed on the reactor walls. The PCB concentration of the oil samples analyzed are presented in Table I.

EXAMPLE 2

Transformer oil (1600 grams) contaminated with the same PCB's as the oil of Example 1 (about 500 ppm) was poured into the reaction vessel and heated to about 130° C. Potassium hydroxide pellets (32 grams) which were about 85% anhydrous, as obtained from MCB Chemical, were added to the vessel. Instantaneous potassium hydroxide dissociation to fine particles was observed. The mixture was cooled to 90° C. to yield a fine potassium hydroxide powder uniformly suspended in the oil. Monocapped polyethylene glycol methyl ether (32 grams) having a molecular weight of about 350 was added to the vessel. The reactor contents were agitated with an impeller as indicated in Example 1. The reactor contents were kept at 90° C. throughout the run. The reaction proceeded for about 20 minutes and samples were withdrawn for PCB analysis every 5 minutes. The results of the PCB analysis are presented in Table I below. Following the reaction, the reactor contents were drained and a relatively cleaner reactor was observed as compared to that of Example 1.

TABLE I

| | PCB Analysis | |
|---|---|---|
| Reaction Time | Example 1 (ppm PCB's) | Example 2 (ppm PCB's) |
| 0 minutes | 500.0 | 500.0 |
| 5 minutes | 232.0 | 126.6 |
| 10 minutes | 163.7 | 43.3 |
| 15 minutes | 110.6 | 12.8 |
| 20 minutes | 64.5 | 8.03 |

EXAMPLE 3

Transformer oil (1600 grams) contaminated with polychlorinated biphenyls (approximately 500 ppm) was poured into a reaction vessel and heated to about 95° C. The reagents potassium hydroxide (32grams) and monocapped polyethylene glycol methyl ether (32 grams, average molecular weight 350) were added to the vessel. The potassium hydroxide used was in powder form. This powder was obtained by grinding potassium hydroxide flakes (about 90% anhydrous) as obtained from LCP Chemicals and Plastics Inc., Edison, N.J., in a blender. The reaction contents were agitated throughout the run (3 inch pitched blade impeller, 600 rpm) and maintained at 95° C. Reaction was carried on for 45 minutes and samples were withdrawn for PCB analysis every 5 minutes. Following the reaction, the reactor contents were drained. The PCB concentration of the oil samples are presented in Table II.

EXAMPLE 4

Transformer oil (1600 grams) contaminated with the same PCB's as the oil of Example 3 (about 500 ppm) was poured into the reaction vessel and heated to about 140° C. Potassium hydroxide flakes (32 grams) which were about 90% anhydrous, as obtained from LCP Chemicals and Plastics Inc., Edison, N.J. were added to the vessel. Instantaneous potassium hydroxide dissociation to fine particles was observed. The mixture was cooled to 95° C. to yield a fine potassium hydroxide powder uniformly suspended in the oil. Monocapped polyethylene glycol methyl ether (32 grams) having a molecular weight of about 350 was added to the vessel. The reactor contents were agitated with an impeller as indicated in Example 1. The reactor contents were kept at 95° C. throughout the run. The reaction proceeded for. about 45 minutes and samples were withdrawn for PCB analysis every 5 minutes. The results of the PCB analysis are presented in Table II below. Following the reaction, the reactor contents were drained and a relatively cleaner reactor was observed as compared to that of Example 3.

TABLE II

| | PCB Analysis | |
|---|---|---|
| Reaction Time | Example 3 (ppm PCB's) | Example 4 (ppm PCB's) |
| 0 | 500.0 | 500.0 |
| 5 | 143.5 | 13.7 |
| 10 | 94.8 | 5.4 |
| 15 | 58.4 | 3.0 |
| 25 | 30.7 | 1.2 |
| 45 | 8.1 | 0.34 |

Modifications of the above embodiments, will be obvious to those skilled in the art and are considered to be within the scope of this invention.

What is claimed is:

1. A method for reducing the quantity of polyhalogenated aromatic hydrocarbon in an inert, organic solvent solution which comprises:

(A) admixing particles of alkali metal hydroxide with a substantially inert, organic solvent solution containing polyhalogenated hydrocarbons to form a slurry of substantially uniform alkali metal hydroxide solids having an average size less than about 100 microns, the temperature of said organic solvent solution being sufficiently high to dissociate the particles of alkali metal hydroxide;

(B) forming a reaction mixture with said slurry, said reaction mixture having a temperature in the range of about 50° C. to 140° C. and comprising about (1) 0.1 to 10% by weight alkali metal hydroxide (2) 0.1 to 10% by weight glycol selected from the group consisting of polyalkylene glycol and monocapped polyalkylene glycol alkyl ether, and (3) an inert, organic solvent solution containing polyhalogenated aromatic hydrocarbons; and (C) agitating said reaction mixture for a time sufficiently long to reduce the quantity of polyhalogenated aromatic hydrocarbons in said reaction mixture.

2. A method as in claim 1 wherein the inert, organic solvent solution contains up to about 5% by weight polyhalogenated aromatic hydrocarbon.

3. A method as in claim 2 wherein the inert, organic solvent is transformer oil.

4. A method as in claim 1 wherein the particles of alkali metal hydroxide are of an average size greater than about 100 microns prior to admixture with said inert organic solvent solution.

5. A method as in claim 1 wherein the average size of the alkali metal hydroxide particles is from about ⅛" to ½" prior to admixture with said inert organic solvent solution.

6. A method as in claim 1 wherein the glycol is polyethylene glycol having a molecular weight in the range of about 200 to 5000.

7. A method as in claim 1 wherein the glycol is monocapped polyethylene glycol methyl ether having a molecular weight in the range of about 350 to 750.

8. A method as in claim 3 wherein the inert, organic solvent solution has a temperature in the range of about 115° C. to 140° C.

9. A method as in claim 1 wherein the temperature of said inert, organic solvent solution is above the melting point of the alkali metal hydroxide and said slurry of substantially uniform alkali metal hydroxide solids is obtained by cooling the admixed alkali metal hydroxide and inert, organic solvent solution to a temperature below about 110° C.

10. A method as in claim 9 wherein the admixed alkali metal hydroxide and inert, non-polar, organic solvent solution are cooled by adding additional inert, non-polar, organic solvent solution having a temperature below about 110° C.

11. A method as in claim 2 wherein the concentration of polyhalogenated aromatic hydrocarbon in said reaction mixture is reduced below 2 ppm.

12. A method for reducing the quantity of polychlorinated biphenyls in transformer oil which comprises:

(A) admixing particles of alkali metal hydroxide with transformer oil containing polychlorinated biphenyls to form a slurry of substantially uniform alkali metal hydroxide solids having an average size less than about 100 microns, the temperature of said transformer oil falling in the range of about 100° C. to 140° C.;

(B) forming a reaction mixture with said slurry, said reaction mixture having a temperature in the range of 50° C. to 140° C. and comprising about (1) 0.1 to 10% by weight alkali metal hydroxide, (2) 0.1 to 10% by weight glycol selected from the group consisting of polyalkylene glycol and monocapped polyalkylene glycol alkyl ether, and (3) 75 to 99.8% by weight transformer oil containing polychlorinated biphenyls; and (C) agitating said reaction mixture for a time sufficiently long to reduce the quantity of polychlorinated biphenyls in said reaction mixture.

13. A method as in claim 12 wherein the transformer oil contains up to 5% by weight polychlorinated biphenyl.

14. A method as in claim 12 wherein the glycol is polyethylene glycol having a molecular weight of about 350.

15. A method as in claim 12 wherein the glycol is monocapped polyethylene glycol methyl ether having a molecular weight of about 350.

16. A method as in claim 13 wherein the concentration of polychlorinated biphenyl in said reaction mixture is reduced below 2 ppm.

17. A method as in claim 12 wherein the particles of alkali metal hydroxide are of an average size greater than 100 microns prior to admixture with said transformer oil.

18. A method as in claim 12 wherein the alkali metal hydroxide particles have an average size of ⅛" to ½" prior to admixture with said transformer oil.

19. A method as in claim 12 wherein said slurry contains up to about 50% by weight alkali metal hydroxide solids.

* * * * *